US006300045B2

(12) United States Patent
Lobo et al.

(10) Patent No.: US 6,300,045 B2
(45) Date of Patent: Oct. 9, 2001

(54) POLYMER OVERCOAT FOR IMAGING ELEMENTS

(75) Inventors: Lloyd A. Lobo, Webster; Mridula Nair, Penfield; Rukmini B. Lobo, Webster; Barry A. Fitzgerald, Holley, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/755,372

(22) Filed: Jan. 5, 2001

Related U.S. Application Data

(62) Division of application No. 09/311,968, filed on May 14, 1999, now Pat. No. 6,197,482.

(51) Int. Cl.[7] ..... G03C 1/765; G03C 1/76; G03C 11/08; G03C 8/52

(52) U.S. Cl. ..... 430/496; 430/512; 430/523; 430/527; 430/531; 430/533; 430/536; 430/961

(58) Field of Search ..... 430/496, 207, 430/350, 961, 536, 512, 527, 523, 531, 533, 432, 403

(56) References Cited

U.S. PATENT DOCUMENTS

| | | | |
|---|---|---|---|
| 2,173,480 | 9/1939 | Jung . | |
| 2,259,009 | 10/1941 | Talbot . | |
| 2,331,746 | 10/1943 | Talbot . | |
| 2,454,043 | 11/1948 | Dimsdale et al. . | |
| 2,588,765 | 3/1952 | Robijns . | |
| 2,602,742 * | 7/1952 | Buskes et al. | 430/496 |
| 2,706,686 | 4/1955 | Hilborn | 430/350 |
| 2,732,305 | 1/1956 | Richman et al. . | |
| 2,761,791 | 9/1956 | Russell . | |
| 2,798,004 | 7/1957 | Weigel . | |
| 2,976,148 | 3/1961 | Walford . | |
| 3,042,522 | 7/1962 | Ben-Ezra . | |
| 3,080,317 | 3/1963 | Tallet et al. . | |
| 3,113,867 | 12/1963 | Van Norman et al. | 96/87 |
| 3,121,606 | 2/1964 | Duane . | |
| 3,190,197 | 6/1965 | Pinder . | |
| 3,206,311 | 9/1965 | Campbell et al. . | |

(List continued on next page.)

FOREIGN PATENT DOCUMENTS

| | | |
|---|---|---|
| 1284294 | 11/1968 | (DE) . |
| 1284295 | 11/1968 | (DE) . |
| 0 880 067 A1 | 11/1998 | (EP) . |
| 955061 | 4/1964 | (GB) . |

(List continued on next page.)

OTHER PUBLICATIONS

*Research Disclosure* No. 36230, Jun. 1994, Combinations of Technology Useful in a Small Format Film.

(List continued on next page.)

*Primary Examiner*—Richard L. Schilling
(74) *Attorney, Agent, or Firm*—Chris P. Konkol

(57) ABSTRACT

The present invention is an imaging element which includes a support, an imaging layer superposed on a side of said support and an overcoat overlying the imaging layer. The overcoat is composed of an organic polymer. The overcoat is discontinuous such that a fraction of the surface area of the imaging layer remains uncovered by said polymer, wherein the fraction of area not covered by the said polymer is from 0.02 to 0.98. The present invention is a photographic which includes a support, a silver halide emulsion layer superposed on a side of said support and an overcoat overlying the silver halide layer. The overcoat is composed of an organic polymer. The overcoat is discontinuous such that a fraction of the surface area of the silver halide emulsion layer remains uncovered by said polymer, wherein the fraction of area not covered by the said polymer is from 0.02 to 0.98. In one embodiment, the discontinuous overcoat is a series of parallel stripes.

14 Claims, 3 Drawing Sheets

U.S. PATENT DOCUMENTS

| | | | | |
|---|---|---|---|---|
| 3,397,980 | | 8/1968 | Stone . | |
| 3,415,970 | | 12/1968 | McDonald | 96/50 |
| 3,443,946 | | 5/1969 | Grabhofer et al. . | |
| 3,489,567 | | 1/1970 | McGraw . | |
| 3,502,473 | | 3/1970 | Snellman et al. . | |
| 3,502,501 | | 3/1970 | Burczyk et al. . | |
| 3,508,947 | | 4/1970 | Hughes . | |
| 3,697,277 | | 10/1972 | King . | |
| 3,733,293 | | 5/1973 | Gallagher et al. . | |
| 3,933,516 | | 1/1976 | Mackey . | |
| 4,004,927 | | 1/1977 | Yamamoto et al. . | |
| 4,047,958 | | 9/1977 | Yoneyama et al. . | |
| 4,092,173 | | 5/1978 | Novak et al. . | |
| 4,171,979 | | 10/1979 | Novak et al. . | |
| 4,238,560 | * | 12/1980 | Nakamura et al. | 430/496 |
| 4,333,998 | | 6/1982 | Leszyk . | |
| 4,419,434 | * | 12/1983 | Molaire et al. | 430/207 |
| 4,426,431 | | 1/1984 | Harasta et al. . | |
| 4,427,964 | | 1/1984 | Ruegsegger . | |
| 4,554,235 | * | 11/1985 | Adair et al. | 430/350 |
| 4,597,794 | | 7/1986 | Ohta et al. . | |
| 4,855,219 | * | 8/1989 | Baschi et al. | 430/496 |
| 4,999,266 | | 3/1991 | Platzer . | |
| 5,179,147 | | 1/1993 | Jones . | |
| 5,368,894 | | 11/1994 | Lammers et al. . | |
| 5,376,434 | | 12/1994 | Ogawa et al. | 430/935 |
| 5,447,832 | | 9/1995 | Wang et al. | 430/523 |
| 5,534,383 | * | 7/1996 | Takahashi et al. | 430/961 |
| 5,804,360 | * | 9/1998 | Schell et al. | 430/961 |
| 5,853,926 | * | 12/1998 | Bohan et al. | 430/536 |
| 5,853,965 | | 12/1998 | Haydock et al. | 430/536 |
| 5,866,282 | | 2/1999 | Bourdelais et al. | 430/536 |
| 5,874,205 | | 2/1999 | Bourdelais et al. | 430/536 |
| 5,888,643 | | 3/1999 | Aylward et al. | 430/536 |
| 5,888,681 | | 3/1999 | Gula et al. | 430/536 |
| 5,888,683 | | 3/1999 | Gula et al. | 430/536 |
| 5,888,714 | | 3/1999 | Bourdelais et al. | 430/536 |

FOREIGN PATENT DOCUMENTS

| | | |
|---|---|---|
| 1143118 | 2/1969 | (GB) . |
| 1198387 | 7/1970 | (GB) . |
| 1263722 | 2/1972 | (GB) . |
| 1320565 | 6/1973 | (GB) . |
| 1320756 | 6/1973 | (GB) . |
| 1320757 | 6/1973 | (GB) . |
| 1430997 | 7/1976 | (GB) . |
| 1466304 | 3/1977 | (GB) . |

OTHER PUBLICATIONS

*Research Disclosure* No. 38957, Sept. 1996, Photographic Silver Halide Emulsions, Preparations, Addenda, Systems and Processing.

*Research Disclosure* No. 37040, Feb. 1995, Heated and/or Cooled Liquid Inflator system.

*Research Disclosure* No. 17643, Dec. 1978, Photographic Silver Halide Emulsions, Preparations, Addenda, Processing and Systems.

T. H. James, editor, "The Theory of the Photographic Process," $4^{th}$ Edition, Macmillan Publishing Co., Inc. 1977.

M. E. Odiotti and V. Colaprico, "Gravure Process and Technology", Gravure Association of America, 1991.

*Research Disclosure* No. 34390, Nov. 1992, Photographic Light–Sensitive Silver Halide Film Can Comprise A Transparent Magnetic Recording Layer, Usually Provided On The Backside Of The Photographic Support.

*Research Disclosure* No. 37038, Feb. 1995, Typical And Preferred Colored Paper, Color Negative, And Color Reversal Photographic Elements And Processing.

*Research Disclosure* No. 308119, Dec. 1989, Photographic Silver Halide Emulsions, Preparations, Addenda, Processing and Systems.

* cited by examiner

POLYMER OVERCOAT FOR IMAGING ELEMENTS

CROSS REFERENCE TO RELATED APPLICATIONS

This is a Divisional of application 09/311,968 filed May 14, 1999, now U.S. Pat. No. 6,197,482.

This application relates to commonly assigned copending application Ser. No. 09/313,555, pending filed simultaneously and incorporated by reference herewith.

FIELD OF THE INVENTION

The present invention relates to imaging elements having discontinuous overcoat. More particularly, the discontinuous overcoat allows processing solution permeation and then the discontinuous overcoat can be fused to form a continuous protective overcoat.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009; 2,331,746; 2,798,004; 3,113,867; 3,190,197; 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described U.S. Pat. Nos. 4,092,173; 4,171,979; 4,333,998 and 4,426,431.

One drawback for the solvent coating method and the radiation cure method is the health and environmental concern of those chemicals to the coating operator. The other drawback, is that these materials need to coated after the processing step. Thus, the processing equipment needs to be modified as well as the personnel running the processing operation needs to be trained. In addition, several lamination techniques are known and practiced in the trade. U.S. Pat. Nos. 3,397,980; 3,697,277 and 4,999,266 describe methods of laminating polymeric sheet film on the processed image as the protective layer. U.S. Pat. No. 5,447,832 describes the use of a protective layer containing a mixture of high and low Tg latices as the water-resistant layer to preserve the antistatic properties of the $V_2O_5$, layer through photographic processing. This protective layer is not applicable to the image forming layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described, is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective. However, all these techniques need to be carried out after the image has been formed, which adds a large cost to final imaged product.

Thus, the ability to provide the desired property of post-process water/stain resistance of the imaged element, at the point of manufacture of the imaging element, is a highly desired feature. However, in order to accomplish this feature, the desired imaging element should be permeable to aqueous solutions during the processing step, but achieve water impermeability after processing, without having to apply additional chemicals or to substantially change the chemicals used in the processing operation.

There remains a need for an aqueous coatable, water-resistant protective overcoat that can be incorporated into an imaging element, which at the same time allows for uninhibited diffusion of photographic processing solutions, and which can then be made impermeable to aqueous solutions after exposure and processing.

SUMMARY OF THE INVENTION

The present invention is an imaging element which includes a support, an imaging layer superposed on a side of said support and an overcoat overlying the imaging layer. The overcoat is composed of an organic polymer. The overcoat is discontinuous such that a fraction of the surface area of the imaging layer remains uncovered by said polymer, wherein the fraction of area not covered by the said polymer is from 0.02 to 0.98. The present invention is a photographic element which includes a support, a silver halide emulsion layer superposed on a side of said support and an overcoat overlying the silver halide layer. The overcoat is composed of an organic polymer. The overcoat is discontinuous such that a fraction of the surface area of the silver halide emulsion layer remains uncovered by said polymer, wherein the fraction of area not covered by the said polymer is from 0.02 to 0.98. In one embodiment, the discontinuous overcoat is a series of parallel stripes.

For a better understanding of the present invention, together with other advantages and capabilities thereof, reference is made to the following detailed description and claims in connection with the above described drawings.

DETAILED DESCRIPTION OF THE INVENTION

The present invention provides a discontinuous polymer overcoat to the imaging side of imaging elements, particularly photographic paper. The discontinuous polymer overcoat of the invention, while allowing a normal exposure and processing step, also provides a continuous, water-impermeable protective layer by using a post-process coalescing step, without substantial change or addition of chemicals in the processing step. The overcoat is formed by coating in a discontinuous manner an aqueous or volatile solvent solution comprising a dispersible or soluble polymer, or a polymer melt on the emulsion side of a sensitized photographic product. After exposure and processing, the product with image is subjected to a fusing step, wherein it is treated in such a way as to cause coalescence of the coated polymer patches, by heat and/or pressure, solvent treatment, or other means so as to form the desired continuous, water impermeable protective layer. In a preferred embodiment the polymer comprises a combination of low and high Tg polymers to enable post-process melt flow and coalescence during the fusing step. While it is well known to apply such combinations of polymers, in a continuous manner to elements bearing an image, the application of the same on an imaging element, during its manufacture, prior to any image formation will only work if the overcoat is applied in a discontinuous manner. Otherwise the flow from the low Tg component will cause coalescence prior to processing to give a continuous processing solution impermeable overcoat.

Figure 1:
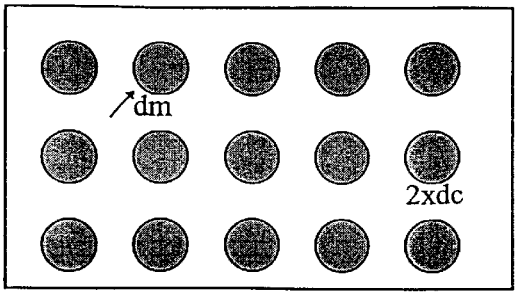
FIG. 1 shows one pattern for a discontinuous overcoat of the present invention.
Figure 2:
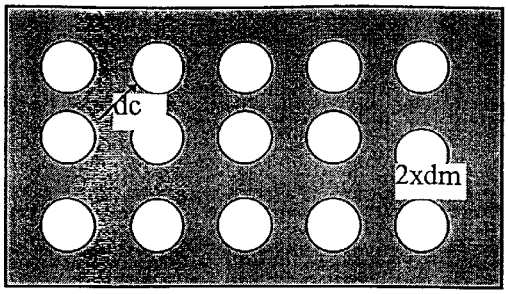
FIG. 2 shows an alternate pattern for a discontinuous overcoat of the present invention.
Figure 3:
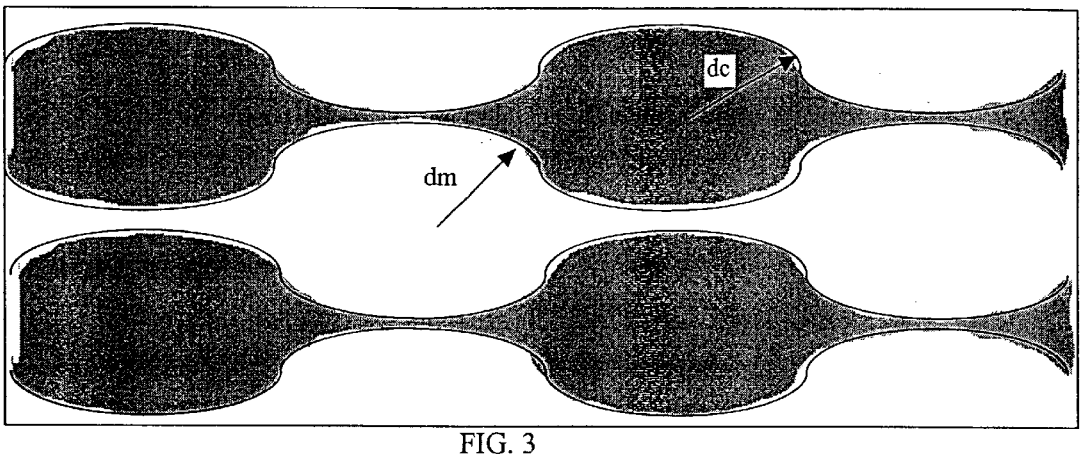
FIG. 3 shows an alternate pattern for a discontinuous overcoat of the present invention.
Figure 4:
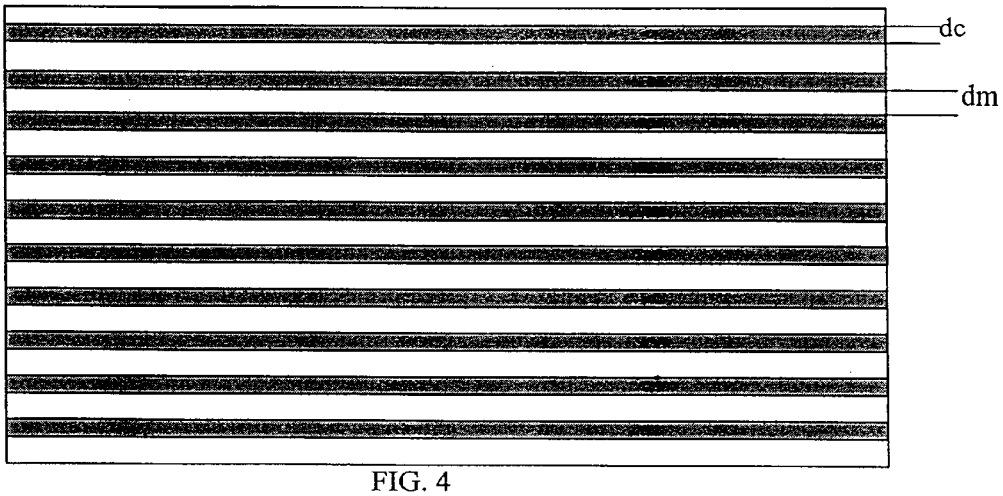
FIG. 4 shows a trihelical pattern for a discontinuous overcoat of the present invention.

Some of the fundamental geometrical patterns that can exist in a discontinuous overcoat are shown in FIGS. 1–4. FIG. 1 shows where the polymer is laid down as discrete patches and resemble islands within the surface of the imaging elements. FIG. 2 shows where the islands are uncoated areas and the rest of the area is covered by the polymer. FIG. 3 show a pattern in which neither the coated nor the uncoated areas are present as discrete patches but each forms a continuous domain. The two continuous area domains coexist, hence this is called bicontinuous. FIG. 4 shows a pattern in which the polymer is laid down parallel stripes, a specific example of a bicontinuous pattern. The common property of these geometries, is that the surface of the imaging element, that is furthest away from the support, is partially covered by a polymer. The percent area of the surface that is covered by the polymer can vary anywhere from 2 to 98%. The above mentioned types of patterns serve as examples of a polymer overcoat applied in a discontinuous manner. However, the current invention applies to all overcoats coated in a discontinuous manner and is not limited to these patterns.

There are certain functional requirements of the parameters of the geometrical patterns that are described as follows:

1) In order to ensure that the polymer can flow into the uncovered areas and coalesce during the fusing step, within an uncovered area, the longest distance (dm) between any point in the uncovered area and the nearest edge of the covered area should not be greater than 500 $\mu$m.
2) In order for the chemical reactions during the processing step to take place uniformly over the entire imaging element, the diffusion time, of chemicals in the underlying swollen gelatin matrix, from the edge of a covered area to its center, should be as short as possible. Within a covered area the longest distance between any point in the covered area and the nearest edge of the uncovered area is defined as dc. Based, on measured diffusion coefficients of developers in a swollen gelatin matrix, it is estimated that the limiting distance dc should not be greater than 100 $\mu$m. However, if the processing solutions have some degree of permeability through the patch, this dimension can be significantly larger and as much as 1 mm.

The graphical representations of the distances dm and dc for each type of geometrical pattern is shown in FIGS. 1–4.

When the discontinuous coating is made of patches as shown in FIG. 1 it is preferred that the spatial frequency be greater than 1000 patches/in$^2$.

The thickness of the polymer patch should be less than 500 $\mu$m, so that the optical properties of the surface of the imaging element are not altered. The ratio of the covered to uncovered, Ar, is limited by the area required to swell and transport processing chemicals into and out of the imaging element. Thus Ar can vary from 1:49 to 49:1, depending on the permeability of the polymer coating under processing conditions. The total coverage of the polymer (based on the total area), Pc, is determined by the needs of the post coalesced coatings. In order that the continuous overcoat, derived from coalescing the discontinuous overcoat, be sufficiently impermeable as well as durable the mean polymer laydown should be at least 0.11 g/m$^2$ over the entire surface area of the imaging element and in order to maintain the image quality, no more than 5.38 g/m$^2$.

The volume of fluid/unit area, that is to be deposited in the covered areas (Vc) in general is given by $$Vc = \frac{Pc\left(1 + \frac{1}{Ar}\right)}{Cp}$$

In the case of the geometric scheme (FIG. 1), where the polymer is laid down as discrete islands or patches, it is useful to know the volume required per patch. The volume per patch Vp (in ml) is given by $$Vp = \frac{Pc}{PI\,Cp}$$

Where Cp is the concentration of the polymer in the coating melt in mg/ml and PI is the number of patches per unit area.

The distance between patches should be such that it enables post process coalescence, and therefore, not be greater than 1 mm.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in U.S. Pat. Nos. 5,853,965, 5,866,282, 5,874,205, 5,888,643, 5,888,681, 5,888,683, and 5,888,714, incorporated by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The imaging elements to which this invention relates can be any of many different types depending on the particular use for which they are intended. Such elements include, for example, photographic, electrostatographic, photothermographic, migration, electrothermographic, dielectric recording, and thermal dye-transfer imaging elements.

Examples of polymer solutions/dispersions used in this invention are derived can be selected from, for example, polymers of alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, butadiene, chlorinated propylene and copolymers therof. Suitable polymers containing carboxylic acid groups include polymers derived from acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Other polymers include ethyl cellulose, nitrocellulose, linseed oil-modified alkyd resins, rosin-modified alkyd resins, phenol-modified alkyd resins, phenolic resins, polyesters, poly(vinyl butyral), polyisocyanate resins, polyurethanes, polyamides, chroman resins, dammar gum, ketone resins, maleic acid resins, poly(tetrafluoroethylene-hexafluoropropylene), low-molecular weight polyethylene, phenol-modified pentaerytbritol esters, copolymers with siloxanes and polyalkenes. These polymers can be used either alone or in combination. The polymers may be crosslinked or branched.

In order to enable post-process melt flow and coalescence during the fusing step, in a particular embodiment the coating composition is composed of a mixture of high (B) and low (A) Tg polymers. The low Tg polymer A, having a Tg less than 30° C., is present in the patches in an amount of from 5 to 70 percent by weight and preferably from 10 to 50 percent by weight based on the total weight of the discontinuous layer. An aqueous coating formulation of 3% by weight of the colloidal polymer free of organic solvent or coalescing aid, is applied to a subbed sheet of polyethylene terephthalate in a wet coverage of 10 ml/m$^2$ and dried for 30 minutes at 30° C. Polymers that form clear, transparent continuous films under these conditions are low Tg and film-forming, while those that do not form clear, transparent continuous films are high Tg and non-film-forming at room temperature, for the purpose of this invention.

The high Tg polymer (B), having a Tg greater than 30° C. comprises glassy polymers that provide resistance to blocking, ferrotyping, abrasion and scratches. High Tg polymer B is present in the coating composition and in the overcoat layer in an amount of from 30 to 80 and preferably from 50 to 70 percent based on the total weight of low Tg polymer (A) and high Tg polymer (B). These polymers include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other polymers that may comprise component B include water-dispersible condensation polymers such as polyesters, polyurethanes, polyamides, and epoxies. Polymers suitable for component B do not give transparent, continuous films upon drying at temperatures below 30° C. when the above-described test is applied.

The low Tg polymer (A) comprises polymers that form a continuous film under the extremely fast drying conditions typical of the photographic film manufacturing process. Polymers that are suitable for component A are those that give transparent, continuous films when the above-described test is applied and include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other suitable polymers useful as component A are low Tg dispersions of polyurethanes or polyesterionomers.

In order to increase the permeability of the discontinuous overcoat and also to extend the size of each polymer patch in accordance with equation 1, a preferred polymeric material is one that would allow some degree of permeability through the patch itself One such preferred polymer is a hybrid urethane-vinyl copolymer having an acid number of greater than or equal to 5 and less than or equal to 30. Acid number is in general determined by titration and is defined as the number of milligrams of potassium hydroxide (KOH) required to neutralize 1 gram of the polymer as described in U.S. Ser. No. 09/235,436. Polyurethanes provide advantageous properties such as good film-formation, good chemical resistance, abrasion-resistance, toughness, elasticity and durability. Further, polyester based urethanes exhibit high levels of tensile and flexural strength, good abrasion resistance and resistance to various oils. Acrylics have the added advantage of good adhesion, non-yellowing, adjustable for high gloss and a wide range of glass transition (Tg) and minimum film forming temperatures. The urethane vinyl hybrid polymers are very different from blends of the two. Polymerization of the vinyl monomer in the presence of the polyurethane causes the two polymers to reside in the same latex particle as an interpenetrating or semi-interpenetrating network resulting in improved resistance to water, organic solvents and environmental conditions, improved tensile strength and modulus of elasticity. The presence of acid groups such as carboxylic acid groups provide a conduit for processing solutions to permeate the patches at high pH. Maintaining the acid number greater than 30 ensures that the overcoat has good adhesion to the substrate below even at high pH and makes the overcoat more water resistant. The overcoat layer formed after coalescing the patches in accordance with this invention is particularly advantageous due to superior physical properties including excellent resistance to water, fingerprinting, fading and yellowing, exceptional transparency and toughness necessary for providing resistance to scratches, abrasion, blocking, and ferrotyping.

The discontinuous polymer coating should be clear, i.e., transparent, and preferably colorless. But it is specifically contemplated that the coated areas can have some color for the purposes of color correction, or for special effects, so long as the image is viewable through the overcoat. Thus, there can be incorporated into the polymer dye which will impart color. In addition, additives can be incorporated into the coating formulation which will give to the overcoat desired properties. For example, a UV absorber can be incorporated into the polymer particle to make the overcoat UV absorptive, thus protecting the image from UV induced fading. Other additional compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include any soluble polymer or other material that imparts appreciable viscosity to the coating suspension at rest and shear thinning otherwise, such as high MW polysaccharide derivatives (e.g. xanthan gum, guar gum, gum acacia, Keltrol (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The step of transforming the discontinuous overcoat into the continuous one is termed as a "fusing" step. In one embodiment, the reduced aqueous permeability afforded by the discontinuous overcoat would not require a fusing step. In other embodiments where a total or partial fusing is desirable, the fusing step can be carried out by several means. The easiest method of making the fusing occur is to heat the element to a temperature above the Tg of the polymer material that forms the overcoat and apply mild pressure to force the polymer to flow. In a usual photoprocessing operation, the final step includes drying the imaged element in a dryer at elevated temperature. Depending on the Tg of the polymer and its melt viscosity characteristics, the temperature in the dryer can be adjusted such that fusing occurs. Another method of fusing during the photoprocessing step is to add a coalescing aid at one step within the photoprocessing operation. Typically, the coalescing aid will be added to the last wet operation, i.e., the wash step. Examples of coalescing aids that can be added to the wash water are aqueous soluble glycol ethers such as Dowanol. If the fusing step is desired to be separate from the photoprocessing step, it can be accomplished chemically as described or in a combination of a heat and pressure application step. A belt or roller fuser device may be used to apply heat and pressure to the imaged element. However, at normal humidity levels at which this flusing operation would be carried out, the Tg of the underlying gelatin matrix would be lower or close to that of the polymer itself. In this case the problem that is encountered in the fusing step is that the discrete areas coated with the polymer sink into the gelatin matrix rather than deform laterally. Thus, depending on the properties of the polymer and the moisture content of the gelatin, (although some amount of lateral diffusion is present,) the deformation of the underlying gelatin matrix may prevent complete fusion of the overcoat. In this instance a specific geometrical pattern that would distribute the pressure and minimize the deformation of the gelatin, would enable the overcoat to fuse. The special case of parallel striped pattern (as shown in FIG. 4) would be preferred to aid fusing. The striped pattern is expected to distribute the applied fusing pressure evenly. In addition, the distance of polymer flow is uniform throughout the whole pattern.

Additionally, in order to aid the fusing step, during which the discontinuous polymer overcoat is made continuous, it is sometimes required that the viscosity of the polymer melt, at the fusion temperatures, be lowered in order to improve the melt flow and coalecsence of the patches. One way of accomplishing this is to add plasticizers. A plasticizer is a substance or material incorporated in the polymer melt to increase its flexibility, workability or extensibility. A plasticizer usually reduces the melt viscosity, lowers the temperature of a second order transition or lowers the elastic modulus of the polymer. Examples of useful plasticizers are esters of phthalic acid, phosphoric acid, aliphatic diacids or liquid polymers or oligomers with a relatively low glass transition temperature and include phthalates, adipates, trimellitates, benzoic acid esters, azelates, isobutyrates, glutarate esters, citrate esters, petroleum oils, mineral oils, and phosphate esters. Additional plasticizers can be selected from those described by Sears, J. K. and Darby, J. R. in The Technology of Plasticizers (John Wiley & Sons, NY 1982). More specific examples of plasticizers include di-2-ethylhexyl terephthalate, di-2-ethylhexyl phthalate (DOP), dibutyl phthalate (DBP), ditridecylphthalate (DTP), dioctyl terephthalate, butyl benzyl phthalate (BBP), dipropylene glycol dibenzoate, di-n-butyl azelate, di-n-hexyl azelate, di-2-ethylhexyl azelate, 2,2,4-trimethyl-1,3-pentanediol, diisodecyl glutarate, triethyl citrate, triaryl phosphate ester, tricresyl phosphate (TCP), diocty adipate (DOA), alkyl diaryl phosphates, glycol ethers such as Texanol and Dowanol and many others known to a person of ordinary skill in the art. The amount of plasticizer required depends on the properties of the polymer, such as Tg and molecular weight, and its chemical identity. Levels of plasticizer up to 50% of the total polymer present may be used. Careful choice of the type and amount of plasticizer is critical because excessive amounts of plasticizer will degrade the desired mechanical properties of the overcoat. In the case of aqueous latex suspensions used in this invention, the plasticizers can be added directly to the suspension and it can be loaded into the latex particles by simple mixing. In the case of polymer melts the plasticizer can be added directly to the melt. Alternately, the plasticizer can be incorporated during the synthesis of the polymer.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is fused. For example, in contact fusing the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in Gennan Patent Nos. 1,284,295 and 1,284,294; (3) liquid paraffin and paraffin or wax like materials such as camauba wax, natural and synthetic waxes, petroleum waxes, mineral waxes and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, and the like. Lubricants useful in the present invention are described in further detail in *Research Disclosure* No. 308119, published December 1989, page 1006.

There are several methods by which a discontinuous coating can be made on an imaging element. In principle, any method that coats or prints an image onto a substrate can be utilized. These include but are not limited to, gravure and rotogravure coating, ink-jet, flexographic, relief printing, planographic printing and intaglio printing.

The gravure coating method utilizes an engraved gravure cylinder to apply a coating composition on to a web. The desired continuous pattern of the types described in FIGS. 1–3 is engraved on the gravure cylinder. The cylinder is filled with the coating solution by dipping into a pool of the same coating solution, the excess fluid is scraped off the cylinder and the cylinder is then brought into contact with the photographic element to be overcoated. Thus, the desired pattern of the polymer is deposited on to the photographic element.

Ink-jet printing is a non-impact method that in response to a digital signal produces droplets of ink that are deposited on a substrate such as paper or transparent film. Ink-jet printing systems generally are of two types: continuous stream and drop-on-demand. In continuous stream ink jet systems, ink is emitted in a continuous stream under pressure through at least one orifice or nozzle. The electrically charged ink droplets are passed through an applied electrode which is controlled and switched on and off in accordance with digital data signals. Charged ink droplets are passed through a controllable electric field which adjusts the trajectory of each droplet in order to direct it to either a gutter for ink deletion and recirculation or a specific location on a recording medium to create images. In drop-on-demand systems, a droplet is ejected from an orifice directly to a position on a recording medium by pressure created by, for example, a piezoelectric device, an acoustic device, or a thermal process controlled in accordance with digital data signals. Further variations and details of the ink-jet process can be found in U.S. Pat. No. 4,597,794. The ink is replaced with a coating solution in accordance with this invention. In addition it should have sufficiently low surface tension to facilitate drop break up at the nozzles. The required pattern can be programmed digitally using a computer and the digital information can be transmitted to the printer. The ink-jet coating method has the advantage of being the most flexible with respect to the geometry of the patchwise pattern.

Screen printing, is another method used to "print" images on to a substrate. In its simplest method the desired patchwise pattern is photographically transferred to a piece of film the image being black, the rest of the film being clear. Next, a porous mesh of fine silk, Nylon, Dacron.RTM. polyester fiber or stainless steel (all generally referred to as silk screen material in the art) is stretched and mounted on a frame. This is now a "silk screen". (Typically, a silk screen used on automated machines of the type described herein, measures approximately 24"*30".) The entire silk screen is coated with a light-sensitive, photochemical translucent emulsion, and is now ready to be processed. The film positive is then temporarily bonded to the screen, and with the aid of a screen developing machine, photochemically developed. Thus, the image portion of the film positive will burn through the emulsion, leaving that portion of the screen mesh open and porous, while the non-image areas of the film positive will have no effect on the emulsion, thus leaving it on the screen. After the film positive is removed, the screen may then be placed directly onto the surface to be printed, which in this case is the emulsion side of the imaging element. The coating fluid consisting of the latex solution is put on the screen at one end, and with the aid of an elongated hard piece of rubber or the like, called a "squeegee", the fluid is drawn across the screen and forced through the open, or burned-in, portions of the fine screen mesh onto the emulsion surface, thus transferring the latex polymer in the desired discontinuous pattern to the imaging element (fluid will be blocked from passing through the non-image portions of the screen by the emulsion remaining on the screen.). In a preferred embodiment of this method, the discontinuous pattern can be formed by using the entire screen without an image formed on the screen. By suitably designing the mesh of the screen the polymer solution will be deposited as discrete dots, separated by the thickness of the mesh.

In addition to the gravure coating methods, ink-jet printing methods and silk screen printing, other methods well known in the printing trade, can be employed to deliver a discontinuous coating of the polymer. These include the various methods of Planographic printing, Porous or screen printing, intaglio printing, flexographic and relief printing. Descriptions of these and other related methods can be found in "The Printing Industry" by Victor Strauss, Printing industries of America Inc., 1967.

The photographic elements in which the images to be protected can contain conductive layers. Conductive layers can be incorporated into multilayer imaging elements in any of various configurations depending upon the requirements of the specific imaging element. Preferably, the conductive layer is present as a subbing or tie layer underlying a magnetic recording layer on the side of the support opposite the imaging layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the imaging layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an imaging element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the imaging layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10_{10}$ ohms/square, preferably less than $1\times10_{9}$ ohms/square, and more preferably, less than $1\times10_{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

The imaged photographic elements with the coalesced and fused protective overcoat that result from this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are preferred imaged photographic elements for use in this invention.

While a primary purpose of applying an overcoat to imaging elements in accordance with this invention is to protect the resulting imaged element from physical damage, the presence of the overcoat may also protect the image from fading or yellowing. This is particularly true with elements which contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

The photographic elements in which the images to be protected are formed can have the structures and components shown in *Research Disclosures* 37038 and 38957 and as disclosed in U.S. Ser. No. 09/299,395, filed Apr. 26, 1999 and U.S. Ser. No. 09/299,548, filed Apr. 26, 1999, incorporated by reference herein. Specific photographic elements can be those shown on pages 96–98 of *Research Disclosure* 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of *Research Disclosures* 37038 and 38957. Color materials and development modifiers are described in Sections V through XX of *Research Disclosures* 37038 and 38957. Vehicles are described in Section II of *Research Disclosures* 37038 and 38957, and various additives such as brighteners, antifoggants, stabilizers, light absorbing and scattering materials, hardeners, coating aids, plasticizers, lubricants and matting agents are described in Sections VI through X and XI through XIV of *Research Disclosures* 37038 and 38957. Processing methods and agents are described in Sections XIX and XX of *Research Disclosures* 37038 and 38957, and methods of exposure are described in Section XVI of *Research Disclosures* 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

EXAMPLES

The present invention is illustrated by the following examples.

Example 1–10

The discontinuous polymer overcoats were made on a tricolor light sensitive imaging element coated on a reflective paper support in the formulation described below. The gelatin containing layers were hardened with bis (vinylsulfonyl methyl) ether at 1.95% of the total gelatin weight.

| Layer | Laydown (g/m$^2$) |
|---|---|
| Overcoat | 0.557 Gelatin |
| | 0.002 SURF-1 |
| | 0.002 SURF-2 |
| | 0.204 Silica |
| | 0.017 Polydimethylsiloxane |
| UV | 0.111 UV-1 |
| | 0.019 UV-2 |
| | 0.033 SCV-1 |
| | 0.022 S-1 |
| | 0.022 S-2 |
| | 0.446 Gelatin |
| Cyan | 0.16 Red light sensitive AgX |
| | 0.365 C-1 |
| | 0.362 S-2 |
| | 0.028 S-3 |
| | 0.230 UV-1 |
| | 1.170 Gelatin |
| UV | 0.158 UV-1 |
| | 0.028 UV-2 |
| | 0.046 SCV-1 |
| | 0.032 S-1 |
| | 0.032 S-2 |
| | 0.630 Gelatin |
| Magenta | 0.067 Green-light sensitive AgX |
| | 0.280 C-2 |
| | 0.076 S-2 |
| | 0.033 S-4 |
| | 0.167 ST-1 |
| | 0.019 ST-2 |
| | 0.530 ST-3 |
| | 1.087 Gelatin |
| IL | 0.056 SCV-1 |
| | 0.163 S-2 |
| | 0.650 Gelatin |
| Yellow | 0.186 Blue-light sensitive AgX |
| | 0.42 C-3 |
| | 0.42 P-1 |
| | 0.186 S-2 |
| | 0.10 SCV-2 |
| | 1.133 Gelatin |

Phiotographic paper support sublayer 1: resin coat (Titanox and optic brightener in polyethylene)

sublayer 2: paper sublayer 3: resin coat (polyethylene)

C-1 Butanamide 2-[2,4-bis(1,1-dimethylpropyl)phenoxy]-N-(3,5-dichloro-4-ethyl-2-hydroxyphenyl)

C-2

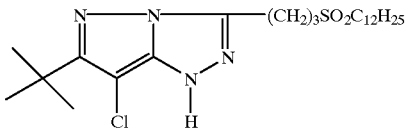

C-3

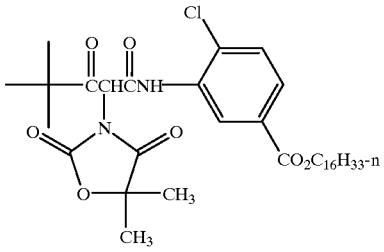

P-1

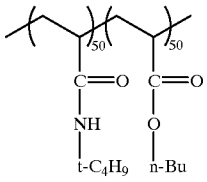

S-1 1,4-Cyclohexylenedimethylene bis(2-ethylhexaneoate)

S-2

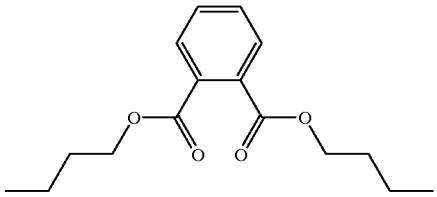

S-3 2-(2-Butoxyethoxy)ethyl acetate

S-4 Di-undecylphthalate

SCV-1

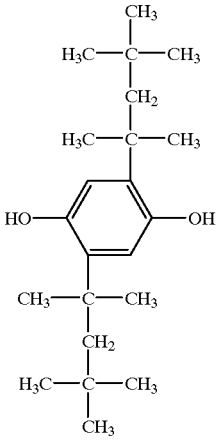

SCV-2 benzenesulfonic acid 2,5-dihydroxy-4-(1-methylheptadecyl)-

-continued mono-potassium salt

ST-1

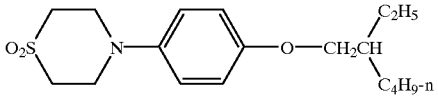

ST-2

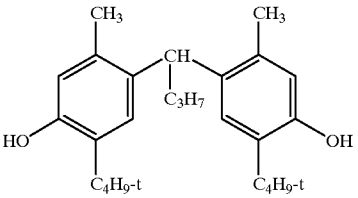

ST-3

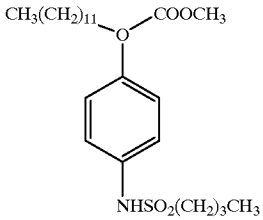

SURF-1

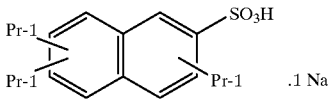

SURF-2 $C_8F_{17}SO_3N(C_2H_5)_4$

UV-1

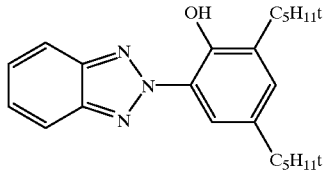

UV-2

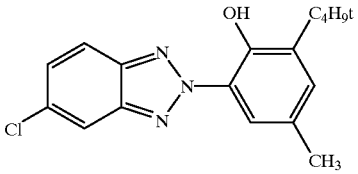

The discontinuous coatings were achieved using a gravure coating method as described in "Gravure Process and Technology", by M. E. Odiotti and V. J. Colaprico, Gravure Association of America, 1991.

Engraved Cylinder and Patterns: The discontinuous coating patterns used in these examples were of the type shown in FIG. 1, with discrete polymer patches coated as islands. The engraving geometries were made on copper and chrome plated stainless steel cylinders. The engravings were made using diamond tips of varying sizes to achieve various geometries. Nine engravings with different geometrical patterns containing patches were designed and prepared. The variables in the design included ratio of the uncoated area to the coated area, size of each individual patch, and the maximum distance between the edges of adjacent patches. Some of the patterns were also designed to obtain variation in the average wet coverage deposited from the engraved pattern. It was assumed, based on knowledge in the art of gravure coating, that the amount of fluid deposited in each patch is 50% of the volume of the engraved cell. Table 1 shows how these factors are varied between each of the pattern geometries. FIGS. 4(*a*)–(*i*) shows the geometrical pattern shape of each engraving along the scale (numbers refer to dimensions in μm). The cell is a single engraved element that is responsible for a single coated patch.

TABLE I

| | | Pattern # | | | | | | | | |
|---|---|---|---|---|---|---|---|---|---|---|
| | | (a) | (b) | (c) | (d) | (e) | (f) | (g) | (h) | (i) |
| stylus angle | | 110 | 110 | 110 | 110 | 120 | 130 | 140 | 140 | 160 |
| compression angle | | 45 | 45 | 60 | 45 | 45 | 45 | 50 | 40 | 60 |
| cell width | μm | 100 | 115 | 100 | 58 | 222 | 213 | 200 | 200 | 375 |
| wall width | μm | 21.98 | 46.31 | 21.98 | 24.06 | 273.67 | 155.54 | 53.63 | 53.63 | 57.02 |
| dist bet cells, 2W | μm | 43.95 | 92.62 | 43.95 | 48.13 | 547.35 | 311.09 | 107.25 | 107.25 | 114.04 |
| cell depth, d | μm | 35.01 | 40.26 | 35.01 | 20.31 | 64.09 | 49.67 | 36.40 | 36.40 | 33.07 |
| cell length, v | μm | 99.99 | 114.99 | 189.28 | 58.00 | 221.98 | 212.98 | 248.62 | 159.18 | 691.21 |
| wall/cell area | | 0.488 | 0.968 | 0.361 | 1.002 | 3.986 | 1.994 | 0.542 | 0.695 | 0.247 |
| % cell area | | 0.672 | 0.508 | 0.735 | 0.499 | 0.201 | 0.334 | 0.649 | 0.590 | 0.802 |
| engraved volume | $cc/ft^2$ | 1 | 1 | 1 | 0.5 | 1 | 1 | 1 | 1 | 1 |
| delivered volume | $cc/ft^2$ | 0.5 | 0.5 | 0.5 | 0.25 | 0.5 | 0.5 | 0.5 | 0.5 | 0.5 |

The polymer used to demonstrate this invention in these examples was an acrylic polymer dispersion NeoCryl A-5090 from Zeneca Resins with a minimum film forming temperature of 6° C. The coating solution was composed of 40 parts by weight of the polymer latex suspension, 0.25 parts by weight of Keltrol T (xanthan gum), 0.1 parts by weight of Olin 10G surfactant and 59.65 parts by weight of water.

Figure 5:
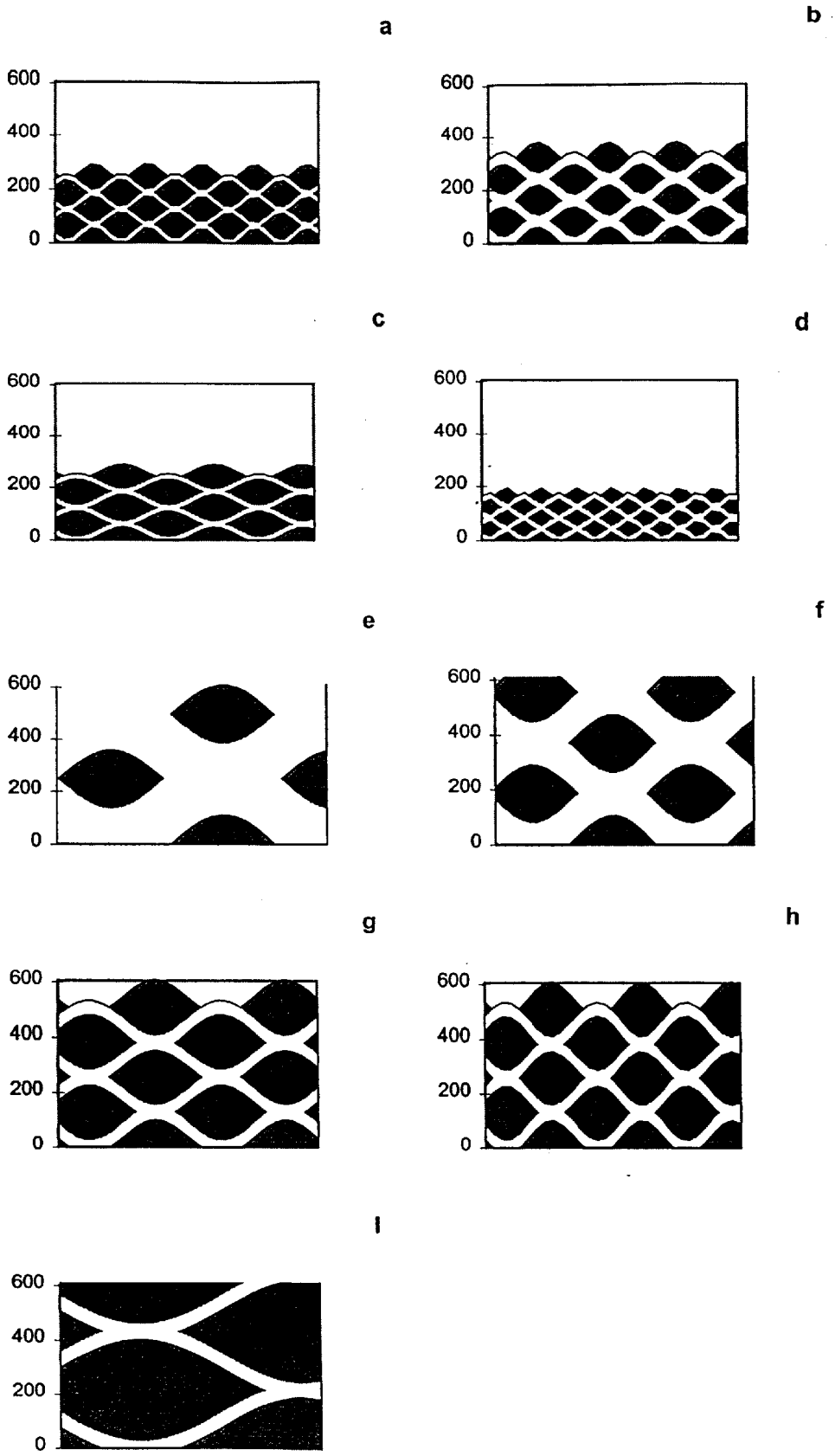
FIGS. 5(*a*)–(*i*) show the geometrical pattern shapes of a series of engravings on various gravure cylinders.
Figure 6:
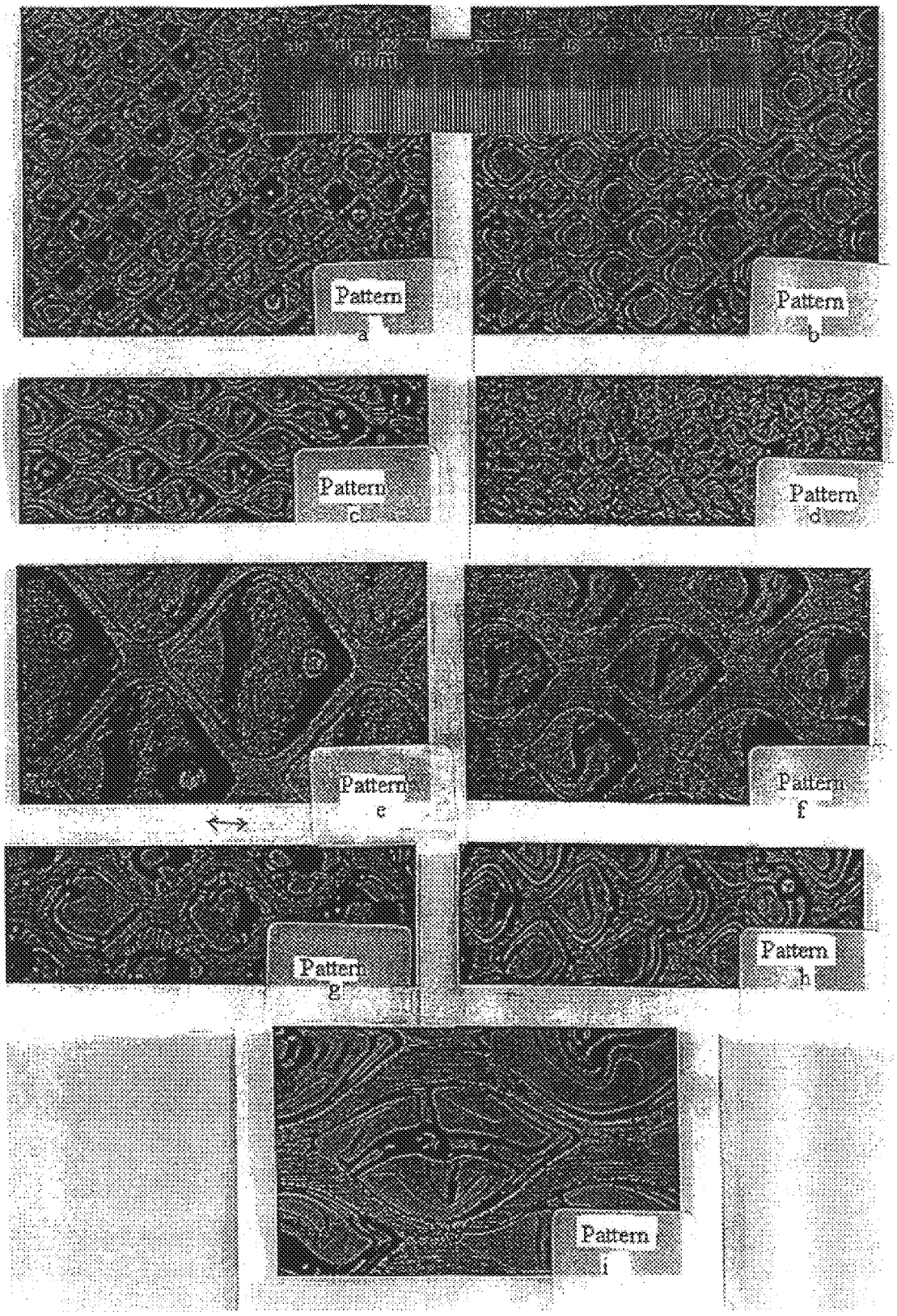
FIGS. 6(*a*)–(*i*) shows photographs of the coatings applied from the gravure cylinders of FIG. 5.

The coating process utilized a typical direct gravure setup, which included (i) a simple pan feed, filled up to the required level for filling the cells, (ii) a standard clamped doctor blade holder using an 8 mil thick blade at a 35 degree application and an attack angle of 55 deg. to the tangent at the point of application, (iii) and a 70 durometer (hardness) backer roller. The blade load was set at 8 psi, and the backer pressure at 10 psi for all the coatings, while a dryer temperature of 82° C. was found to be adequate for drying all the patch variations. By utilizing the optimum Theological profile of the coating solution the polymer latex was deposited in a discontinuous manner with the 9 different geometries. FIGS. 5(*a*)–(*i*) show the actual coated pattterns of the polymer along with the scale.

Strips of the imaging element were subjected to an RA-4 process, which included the following steps:

1) 45 sec at 35° C. in the developer
2) 45 sec at 35° C. in the Bleach-Fix
3) 1.5 min in water wash The normal time in the developer for the RA4 process is 45 sec. Each strip was subjected to variable times of development of 15, 30, 45s and 60s. The subsequent Blix and wash steps used the standard process. The strips were then passed over a fusing belt at 138° C. at 1"/sec. The density of the strips were read with an X-rite densitometer using Status A filters (400–480nm, 500–575 mn and >600 nm).

The amount of retained silver in the coatings after an RA-4 process was measured using X-ray fluorescence spectroscopy.

Control (A), was the imaging element which had no polymer overcoat. Controls B, C, D were the imaging element with an overcoat of the polymer NeoCryl 5090, laid down in a continuous manner at coverages of 1.08, 2.15 and 4.3 $g/m^2$. The values of the responses measured are shown in Table 2.

TABLE 2

| Example | Overcoat Pattern | *polymer laydown | density at 15 s development time | | | density at 30 s development time | | | density at 45 s development time | | | silver retained |
|---|---|---|---|---|---|---|---|---|---|---|---|---|
| # | geometry | $g/m^2$ | red | green | blue | red | green | blue | red | green | blue | $mg/ft^2$ |
| check | (A) | none | 2.645 | 2.424 | 1.291 | 2.62 | 2.571 | 2.243 | 2.581 | 2.573 | 2.253 | 1.1 |
| check | (B) | 1.08 | 2.172 | 1.639 | 1.038 | 2.452 | 2.401 | 2.132 | 2.492 | 2.444 | 2.208 | 23.4 |
| check | (C) | 2.15 | 1.243 | 0.79 | 0.717 | 2.525 | 2.356 | 1.68 | 2.487 | 2.388 | 2.238 | 31.5 |
| check | (D) | 4.3 | 0.201 | 0.27 | 0.444 | 1.837 | 1.49 | 1.158 | 2.464 | 2.292 | 1.707 | 33.3 |
| 1 | pattern a | 2.15 | 1.316 | 1.146 | 0.746 | 2.304 | 2.252 | 1.536 | 2.281 | 2.327 | 2.019 | 3.2 |
| 2 | pattern b | " | 2.001 | 1.732 | 1.007 | 2.333 | 2.322 | 1.835 | 2.287 | 2.367 | 2.115 | 2.0 |
| 3 | pattern c | " | 1.758 | 1.531 | 0.931 | 2.362 | 2.337 | 1.791 | 2.309 | 2.37 | 2.078 | 3.0 |
| 4 | pattern d | 1.08 | 2.308 | 2.082 | 1.13 | 2.317 | 2.319 | 2.078 | 2.29 | 2.343 | 2.118 | 3.1 |
| 5 | pattern e | 2.15 | 0.586 | 0.52 | 0.481 | 0.938 | 0.906 | 0.839 | 1.485 | 1.502 | 1.223 | 3.3 |
| 6 | pattern f | " | 1.474 | 1.231 | 0.824 | 2.396 | 2.352 | 1.752 | 2.33 | 2.409 | 2.099 | 3.5 |
| 7 | pattern g | " | 1.316 | 1.147 | 0.782 | 2.03 | 1.975 | 1.496 | 2.295 | 2.369 | 2.031 | 2.8 |
| 8 | pattern h | " | 1.315 | 1.136 | 0.742 | 2.29 | 2.24 | 1.547 | 2.3 | 2.339 | 2.008 | 2.7 |
| 9 | pattern i | " | 1.483 | 1.296 | 0.83 | 2.331 | 2.292 | 1.667 | 2.277 | 2.333 | 2.018 | 3.4 |

*The polymer laydown for the discontinuous coating refers to the mean laydown of the polymers over the entire surface area of the imaging element.

With the continuously overcoated controls B–D, we see that the image density formed at short development times is lower that those coated in a discontinuous manner. The density achieved with the discontinuous coatings at short development times is significantly better than the Controls B–D and close to the desired values of Control A. Secondly, it is seen that the bleach/fixing reactions are significantly impaired with the Controls B–D and most of the silver is retained in the coating, thus making it unacceptable for use. The inventions comprising the discontinuous overcoat, on the other hand have retained silver similar to the Control A, suggesting that the bleach/fix reactions are not retarded. The inventions with all the discontinuous overcoats, perform in the processing steps, in a manner comparable to the control A.

Examples 10–15

Discontinuous polymer overcoats were made on a reflective paper support described in Example 1–9. The discontinuous overcoats were made using a gravure coating method and the engraved cylinders used were the same as used in experiments 1–9, corresponding to the geometrical patterns numbered FIGS. 4 (*a*), 4(*b*), 4(*c*), 4(*f*), 4(*g*) and 4(*i*). The average laydown of polymer in all these patterns is 2.15 g/m$^2$.

In these examples the polymer of the invention was a processing solution permeable urethane-acrylic copolymer dispersion NeoPac R-9699 from Zeneca Resins. The coating solution was composed of 40 parts by weight of the polymer latex suspension, 0.1 parts by weight of Keltrol T (xanthan gum), 0.7 parts by weight of poly vinyl pyrrolidone (K90) 0.1 parts by weight of Olin 10 G surfactant and 59 parts by weight of water. Control (E), was the imaging element which had no polymer overcoat. Controls F and G were the imaging element with an overcoat of the polymer laid down in a continuous manner at coverages of 0.54 and 1.08 g/m$^2$.

The coating strips were exposed to white light and then processed at varying times of development, the strips were then passed over a fusing belt at (138° C.) at 1"/sec and the density read as described in examples 1–9. Table 3 shows the values of the density of the blue record at the various times of development.

TABLE 3

| Example # | Overcoat pattern geometry | polymer laydown g/m$^2$ | blue record density at 15 s development time | blue record density at 30 s development time | blue record density at 45 s development time |
|---|---|---|---|---|---|
| Check | (E) | none | 1.16 | 2.118 | 2.134 |
| Check | (F) (continuous coating) | 0.54 | 1.173 | 2.03 | 2.083 |
| Check | (G) (continuous coating) | 1.08 | 0.877 | 1.884 | 2.042 |
| 10 | pattern a | 2.15 | 1.092 | 1.905 | 1.924 |
| 11 | pattern b | " | 1.01 | 1.872 | 1.954 |
| 12 | pattern c | " | 1.015 | 1.92 | 1.965 |
| 13 | pattern f | " | 0.909 | 1.654 | 1.987 |
| 14 | pattern g | " | 0.927 | 1.791 | 1.989 |
| 15 | pattern i | " | 0.985 | 1.721 | 2.004 |

As seen in the table, the discontinuous coating of polymer patches provides for increased development kinetics at short times (higher density at 15s) compared to the continuous coating, at a lower laydown of polymer. In comparing the blue densities at short times of development, to the corresponding densities in Table 2, using a polymer which is not permeable to developer solutions, we see the use of the polymer with a pH switch is better for development kinetics and more advantageous.

Example 16

A similar experiment as described in Experiments 1–9 was carried out using a blend of two polymers. The first polymer NeoCryl A-5090, was the same as used in Experiment 1–9. The second polymer was an acrylic polymer dispersion NeoCryl A-6092 also from Zeneca Resins. It has a glass transition temperature of 56° C. and a minimum film forming temperature of 50° C. The mixture of the high Tg polymer and low Tg polymer was made in the ratio of 1:1 by weight. The polymer concentration in the coating solution was 40% by weight and the concentrations of surfactant and thickener was the same as that used in Experiment 1–9.

The coating strips were exposed to white light and then processed at varying times of development, the strips were then passed over a fusing belt at (138° C.) at 1"/sec and the density read as described in examples 1–9. Table 4 shows the values of the density of the blue record at the various times of development.

Water resistance of the overcoat was measured using an aqueous solution Ponceau Red dye which is known to stain gelatin through ionic interaction. Ponceau Red dye solution was prepared by dissolving 1 gram dye in 1000 grams mixture of acetic acid and water (5 parts: 95 parts). Samples in duplicate, without being exposed to light, were processed through the Kodak RA4 process to obtain white Dmin samples. One of each of these duplicate processed samples was then passed through a set of heated (280–350° F.) pressurized rollers in order to coalesce the discontinuous coating into a continuous layer by fusing. The water permeability was done by placing a drop of the dye solution on the sample for 10 minutes followed by a 30-second water rinse to removed excess dye solution on the coating surface. Each sample was then air dried, and status A reflectance density on the spotted area was recorded. An optical density of 3, such as for Check A indicates a completely water permeable coating its water resistance=0%. Assuming an optical density of 3 (Check A) for 0% water resistance and an optical density of 0 for 100% water resistance, the percent water resistance for a sample is calculated using the following equation.

$$\text{Percent water resistance}=100[1-(\text{status A density}/3)]$$

TABLE 4

| Example # | Overcoat pattern geometry | polymer laydown g/m$^2$ | blue record density at 15 s development time | blue record density at 30 s development time | blue record density at 45 s development time |
|---|---|---|---|---|---|
| Check | (E) | none | 1.16 | 2.118 | 2.134 |
| 16 | pattern (i) | 1.08 | 1.053 | 2.052 | 2.053 |

The discontinuous coating of a blend of polymer latices of high and low Tg provides an imaging element with adequate times of reaction of the developer. The water resistance of the Check E was 0% while that of Example 16 after processing and fusing was 60%.

Example 17

A coating corresponding to the pattern shown in FIG. 4 was produced as follows. The face width of the engraved gravure cylinder and impression cylinder corresponded with the width of the web at 14". The gravure cylinder was made of a stainless steel base with a copper plating and had a diameter of 10". The gravure cylinder was engraved with a trihelical pattern using a hardened steel triangular engraving tool. The engraving had 230 lines per inch engraved at 45° angle to the axis of the cylinder. Each line was microns deep, 90 microns cell width (width of the stripe) on top and 19 microns land width (distance between stripes). The volume engraved was 0.71cc/ft$^2$ of surface area. It was assumed, based on knowledge in the art of gravure coating, that approximately half the volume of fluid is transferred from the cells on to the web. The engraving pattern described above results in a coated pattern composed of parallel stripes. In the case where flow upon coating is negligible, the strip width was 90 microns and the distance between edges of adjacent stripes was 19 microns.

The polymer used to demonstrate this invention was an acrylic polymer dispersion NeoCryl A-5090 from Zeneca Resins. Dibutyl phthalate was added to the latex, as a polymer plasticizer. The dibutyl phthalate was added directly into the latex dispersion at a level of 20% by weight with respect to the polymer. The coating solution was composed of 40 parts by weight of the polymer latex suspension, 0.2 parts by weight of Keltrol T (xanthan gum), 0.5 parts by weight of poly vinyl pyrolidone (Luviskol K90, made by BASF), 0.1 parts by weight of Olin 10 G surfactant and the rest was water.

The gravure coating machine was set up as follows: the blade load was set at 8 psi, and the backer pressure at 10 psi for the coating, while a dryer temperature of 180° F. was found to be adequate for drying all the patch variations. The overcoat was made on the same imaging element as described in Examples 1–9.

The coating strip was processed in Kodak RA4 chemistry. The coating strip was then passed through a roller fliser at 128° C. and a pressure of 23 psi. The water resistance of the check E was 0% while that of Example 17 after processing and fusing was 70% indicating enhanced fusability of the overcoat. When the overcoat pattern is a series of stripes of polymer it is more effective in making the polymer flow together to form a continuous overcoat.

The invention has been described in detail with particular reference to certain preferred embodiments thereof, but it will be understood that variations and modifications can be effected within the spirit and scope of the invention.

What is claimed is:

1. An imaging element comprising in order:

a reflective support;

at least one silver-halide containing photographic imaging layer, superposed on a side of said support, capable of forming an image in the imaging layer during photoprocessing;

an overcoat through which the same image is viewable after photoprocessing is complete, said overcoat overlying said at least one imaging layer and comprising an organic polymer, said overcoat being discontinuous such that a fraction of a surface area of the at least one imaging layer remains uncovered by said polymer, wherein the fraction of area not covered by the said polymer is from 0.02 to 0.98, and wherein a distance between a point in an area not covered by the polymer to a nearest edge of the surface area that is covered by the polymer is less than or equal to 500 $\mu$m.

2. The imaging element of claim 1 wherein a distance between any point in an area covered by the polymer to a nearest edge of an area not covered by the polymer is less than 500 $\mu$m.

3. The imaging element of claim 1 wherein the overcoat comprises a plurality of patches comprising a spatial frequency distribution of from greater than 1000 patches/in$^2$.

4. The imaging element of claim 1 wherein the support comprises polymeric films, papers or glass.

5. The imaging element of claim 1 wherein the overcoat further comprises UV absorbers, surfactants, emulsifiers, coating aids, lubricants, matte particles, rheology modifiers, crosslinking agents, antifoggants, inorganic fillers, pigments, magnetic particles or biocides.

6. The imaging element of claim 1 further comprising an antistatic layer superposed on said support.

7. The imaging element of claim 1 further comprising transparent magnetic layer superposed on said support.

8. The imaging element of claim 1 wherein the organic polymer comprises polymers of alkyl esters of acrylic acid, polymers of alkyl esters of methacrylic acid, the hydroxyalkyl esters of acrylic acid, hydroxyalkyl esters of methacrylic acid, polymers of nitriles of acrylic acid, polymers of nitrites of methacrylic acid, polymers of amides of acrylic acid, polymers of amides of methacrylic acid, polymers of vinyl acetate, polymers of vinyl propionate, polymers of vinylidene chloride, polymers of vinyl chloride, polymers of vinyl aromatic compounds, polymers of dialkyl maleates, polymers of dialkyl itaconates, polymers of dialkyl methylene-malonates, polymers of isoprene, polymers of butadiene, polymers of chlorinated propylene, ethyl cellulose, nitrocellulose, linseed oil-modified alkyd resins, rosin-modified alkyd resins, phenol-modified alkyd resins, phenolic resins, polyesters, poly(vinyl butyral), polyisocyanate resins, polyurethanes, polyamides, chroman resins, dammar gum, ketone resins, maleic acid resins, poly (tetrafluoroethylene-hexafluoropropylene), polyethylene, phenol-modified pentaerythritol esters, polymers with siloxanes or polyalkenes.

9. The imaging element of claim 1 wherein the organic polymer comprises a mixture of a first polymer having a Tg greater than 30° C. and a second polymer having a Tg less than 30° C.

10. The imaging element of claim 9 wherein the first polymer comprises from 30 to 80 percent of the overcoat.

11. The imaging element of claim 9 wherein the second polymer comprises from 5 to 70 percent of the overcoat.

12. The imaging element of claim 1 wherein the organic polymer comprises a urethane-vinyl copolymer having acid functionalities wherein a weight ratio of a urethane component in the copolymer comprises from 20 to 100 percent and a weight ratio of a vinyl component in the copolymer comprises from 0 to 80 percent.urethane-vinyl copolymer having an acid number of greater than or equal to 5 and less than or equal to 30.

13. A photographic element comprising in order:

a reflective support;

at least one silver halide emulsion layer, superposed on a side of said support, capable of forming an image in the imaging layer during photoprocessing;

an overcoat through which the same image is viewable after photoprocessing is complete, said overcoat overlying said at least one silver halide emulsion layer and comprising an organic polymer, said overcoat being discontinuous such that a fraction of a surface area of the at least one silver halide emulsion layer remains uncovered by said polymer, wherein the fraction of area not covered by the said polymer is from 0.02 to 0.98, and wherein a distance between a point in an area not covered by the polymer to a nearest edge of the surface area that is covered by the polymer is less than or equal to 500 $\mu$m and wherein the overcoat comprises a geometric pattern.

14. The photographic element of claim 13 wherein the support comprises a paper base; and a layer of biaxially oriented polyolefin sheet between a first side of said paper base and said at least one silver halide layer.

* * * * *